US009824675B2

(12) United States Patent
Rosenkranz et al.

(10) Patent No.: US 9,824,675 B2
(45) Date of Patent: Nov. 21, 2017

(54) METHOD FOR SUPPRESSING INTERFERENCE NOISE IN AN ACOUSTIC SYSTEM AND ACOUSTIC SYSTEM

(71) Applicant: SIVANTOS PTE. LTD., Singapore (SG)

(72) Inventors: Tobias Daniel Rosenkranz, Erlangen (DE); Tobias Wurzbacher, Fuerth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/062,284

(22) Filed: Mar. 7, 2016

(65) Prior Publication Data

US 2016/0260423 A1 Sep. 8, 2016

(30) Foreign Application Priority Data

Mar. 5, 2015 (DE) ..... 10 2015 204 010

(51) Int. Cl.
*H04B 15/00* (2006.01)
*G10K 11/00* (2006.01)
(Continued)

(52) U.S. Cl.
CPC ..... *G10K 11/002* (2013.01); *H04R 25/453* (2013.01); *G10K 2210/3026* (2013.01); *G10K 2210/3028* (2013.01); *H04R 3/02* (2013.01)

(58) Field of Classification Search
CPC ..... H04R 3/02; G10K 11/175
(Continued)

(56) References Cited

U.S. PATENT DOCUMENTS 7,106,871 B1 * 9/2006 Nielsen ..... H04R 25/453 381/312
8,594,173 B2 11/2013 Andersen et al.
(Continued)

FOREIGN PATENT DOCUMENTS

DE 102011006129 A1 9/2012
DE 102013207403 B3 3/2014
(Continued)

OTHER PUBLICATIONS

Kawther, Essafi, et al.: "A decorrelation based adaptive prediction filter for acoustic feedback cancellation in hearing aids," Information Sciences Signal Processing and Their Applications (ISSPA), 2010 10th International Conference on, IEEE, Piscataway, NJ, USA, May 10, 2010 (May 10, 2010), pp. 69-72, XP031777918.
(Continued)

*Primary Examiner* — Lun-See Lao
(74) *Attorney, Agent, or Firm* — Laurence A. Greenberg; Werner H. Stemer; Ralph E. Locher

(57) ABSTRACT

A method for suppressing interference noise in an acoustic system with a microphone that generates an input signal and a loudspeaker that generates an acoustic signal which partially feeds back to the microphone. A first intermediate signal is formed along a primary signal path as a function of the input signal, and an output signal is formed via a frequency distortion. The output signal is coupled into a signal feedback path. A second intermediate signal is formed in the signal feedback path via a decorrelation and used as an input value for an adaptive filter. The adaptive filter generates a compensation signal which compensates the input signal. A third intermediate signal is formed from the input signal and/or compensated input signal, which is used as an input value for the adaptive filter. The output signal is fed to the loudspeaker for reproduction.

30 Claims, 1 Drawing Sheet

(51) Int. Cl.
*H04R 25/00* (2006.01)
*H04R 3/02* (2006.01)

(58) Field of Classification Search
USPC ..... 381/71.1–71.4, 71.111–71.14, 94.1–94.5, 381/93, 92, 312, 316, 318
See application file for complete search history.

(56) References Cited

U.S. PATENT DOCUMENTS

| | | | | |
|---|---|---|---|---|
| 8,744,102 | B2 | 6/2014 | Klinkby et al. | |
| 9,269,343 | B2 * | 2/2016 | Munk | H04R 3/02 |
| 2006/0291681 | A1 | 12/2006 | Klinkby et al. | |
| 2009/0196445 | A1 | 8/2009 | Elmedyb et al. | |
| 2010/0020979 | A1 | 1/2010 | Elmedyb et al. | |
| 2011/0206226 | A1 | 8/2011 | Pandey et al. | |
| 2012/0243716 | A1 * | 9/2012 | Puder | H04R 25/453 381/318 |
| 2014/0146977 | A1 | 5/2014 | Munk et al. | |
| 2014/0321683 | A1 | 10/2014 | Rosenkranz et al. | |
| 2014/0355802 | A1 | 12/2014 | Elmedyb et al. | |

FOREIGN PATENT DOCUMENTS

| | | | |
|---|---|---|---|
| EP | 2086250 | A1 | 8/2009 |
| EP | 2503795 | A2 | 9/2012 |
| EP | 2736271 | A1 | 5/2014 |
| WO | 2005096670 | A1 | 10/2005 |
| WO | 2007113282 | A1 | 10/2007 |
| WO | 2010027722 | A1 | 3/2010 |

OTHER PUBLICATIONS

Joson, H. A. L., et al.:"Adaptive Feedback Cancellation With Frequency Compression for Hearing Aids," The Journal of the Acoustical Society of America, American Institute of Physics for the Acoustical Society of America, New York, NY, USA, Bd. 94, Nr. 6, Dec. 31, 1993 (Dec. 31, 1993), pp. 3248-3254, XP000407303.

Essafi, Kawther, et al.; "A Decorrelation Based Adaptive Prediction Filter for Acoustic Feedback Cancellation in Hearing Aids"; pp. 69-72; May 2010.

Haykin, Simon S.; "Adaptive Filter Theory", 1996.

* cited by examiner

METHOD FOR SUPPRESSING INTERFERENCE NOISE IN AN ACOUSTIC SYSTEM AND ACOUSTIC SYSTEM

CROSS-REFERENCE TO RELATED APPLICATION

This application claims the priority, under 35 U.S.C. §119, of German application DE 10 2015 204 010.0, filed Mar. 5, 2015; the prior application is herewith incorporated by reference in its entirety.

BACKGROUND OF THE INVENTION

1. Field of the Invention

The present invention relates to a method for suppressing an interference noise in an acoustic system. The acoustic system comprises at least one microphone and at least one loudspeaker. The at least one microphone generates an input signal and the at least one loudspeaker generates an acoustic signal which partially feeds back to the at least one microphone.

In an acoustic system of the type described above, as may be provided, for example, by a hearing device, interference noises caused by feedback may occur. An acoustic feedback may occur as a result of the acoustic signal generated by the loudspeaker being partially detected by the microphone, thereby being reintroduced into the acoustic system. The input signal generated by the microphone is amplified in the acoustic system, so that within the closed loop which is formed by the loudspeaker, the acoustic signal generated by the loudspeaker, the microphone, and the signal processing unit within the acoustic system, a signal component is constantly amplified into a whistling interference noise via the feedback, if the amplification during the signal processing exceeds a certain limit value within the acoustic system.

Such interference noises may be reduced or even eliminated via so-called feedback suppression methods (feedback cancelers). For this purpose, according to the related art, adaptive feedback cancelation methods are often used, in which an adaptive filter having filter coefficients h models the time-dependent impulse response of the acoustic feedback path. A frequently used example of a rule for adapting the filter coefficients h is provided by the normalized least mean square algorithm (NLMS):

$$h(k+1)=h(k)+\mu e^*(k)\times(k)/|x(k)|^2.$$

Here, k is the discrete time index, x is the input into the system for canceling the feedback, e=m−c is the error signal, which is defined as the difference between the input signal m generated by the microphone and the compensation signal c for compensating for the feedback. μ is the increment via which the speed of the adaptation or convergence is controlled, and * denotes the complex conjugation.

In a realistic acoustic system, the input signal m is often initially digitized at a comparatively high sampling rate and is thereby converted into discrete-time sample values. Subsequently, a plurality of successive sample values, for example, 128, is combined into a so-called frame in each case. Within a frame, a spectral analysis of the input signal may be carried out at this point by means of Fourier transformation, based on the sample values forming the frame. For the generation or analysis of a subsequent frame, the window to be examined is shifted by several sample values, for example, 32, in the direction of the time axis, so that the windows of the sample values for each frame to be considered partially, significantly overlap for adjacent frames. In this case, the time index may be regarded as a frame index, wherein the adaptive filter may also be used in the frequency domain. In this case, the filter coefficients h are vectors whose entries correspond to each spectral subband. However, the application is not limited to this case. Further details may be found, for example, in S. Haykin, "Adaptive Filter Theory" (Englewood Cliffs, N.J.: Prentice-Hall, 1996) or T. v. Waterschoot & M. Moonen, "Fifty years of acoustic feedback control: state of the art and future challenges" (Proc. IEEE, Vol. 99, No. 2, February 2011, pp. 288-327).

It is a known problem that correlated input signals, as, for example, may be generated by picking up music or spoken language, may result in a divergence in an adaptive filter, which may result in an at least partial cancellation of a target signal. This may produce significantly perceptible signal artifacts in the output signal, resulting in a considerable degradation of the sound quality. The whistling interference noises generated via an acoustic feedback also have a high correlation in the relevant signals, in particular if a correlated target signal is present which is picked up and fed back after being reproduced by a loudspeaker. If an adaptive filter is used at this point for suppressing the interference noises thereby generated, signal components of the target signal may thus also be at least partially canceled during the suppression of the interference signal of the feedback, which has a negative effect on the sound quality of the output signal.

SUMMARY OF THE INVENTION

It is accordingly an object of the invention to provide a method for suppressing interference noise in an acoustic system which overcomes the above-mentioned and other disadvantages of the heretofore-known devices and methods of this general type and which allows the use of an adaptive filter and simultaneously has a sound quality in the output signal which is as high as possible.

With the foregoing and other objects in view there is provided, in accordance with the invention, a method for suppressing an interference noise in an acoustic system, wherein the acoustic system including at least one microphone and at least one loudspeaker, the at least one microphone generating an input signal and the at least one loudspeaker generating an acoustic signal which partially feeds back to the at least one microphone, the method comprising:

forming a first intermediate signal along a primary signal path as a function of the input signal and forming an output signal from the first intermediate signal via a frequency distortion;

coupling the output signal out from the primary signal path into a signal feedback path;

forming a second intermediate signal in the signal feedback path from the output signal via a decorrelation, inputting the second intermediate signal as an input value for an adaptive filter, generating a compensation signal by the adaptive filter, and feeding the compensation signal to the input signal to form a compensated input signal;

forming a third intermediate signal from the input signal and/or from the compensated input signal, and using the third intermediate signal as an input value for the adaptive filter; and feeding the output signal to the at least one loudspeaker for reproduction.

In other words, the above-mentioned object is achieved according to the present invention via a method for suppressing an interference noise in an acoustic system, wherein the acoustic system comprises at least one microphone and at least one loudspeaker, wherein the at least one microphone generates an input signal, and wherein the at least one loudspeaker generates an acoustic signal which partially feeds back to the at least one microphone, wherein a first intermediate signal is formed along a primary signal path as a function of the input signal, and an output signal is formed from the first intermediate signal via a frequency distortion, wherein the output signal is coupled out from the primary signal path into a signal feedback path, wherein a second intermediate signal is formed in the signal feedback path from the output signal via a decorrelation, which is used as an input value for an adaptive filter, which generates a compensation signal, and wherein the compensation signal is fed to the input signal for compensation, wherein a third intermediate signal is formed from the input signal and/or from the compensated input signal, which is used as an input value for the adaptive filter, and wherein the output signal is fed to the at least one loudspeaker for reproduction. Advantageous and in part in themselves inventive designs are described in the sub claims and the following description.

In particular, the output signal may also be used as an additional input value for the adaptive filter, wherein the second intermediate signal and the third intermediate signal are used in the adaptive filter for determining filter coefficients, by means of which the output signal is filtered and the compensation signal is thereby generated.

The present invention is based on the following concepts:

A reduction of the increment p of an applied adaptive filter would result in the filter diverging significantly more slowly in the case of a correlated input signal, so that undesired artifacts in the output signal could be reduced or become inaudible. In this case, the reduction of the increment could, for example, always occur if a correlated or tonal input signal is registered. However, one disadvantage of such an approach is that, while the correlated signal is being registered, it is not possible to track every change in the acoustic feedback path fast enough to prevent interference noises caused by the feedback, since limitations are set on the adaptability of the filter as a result of the reduced increment μ. The increment must therefore always be regarded as a trade-off between the sound quality and the capability of responding to changes in the acoustic feedback path.

Another option for solving the problems of an adaptive filter for a highly correlated input signal is a possible decorrelation of the input signal (so-called pre-whitening). Since only correlated input signals cause problems with the adaptation in the adaptive filter, such a decorrelation could initially solve the problem. Such a decorrelation is often implemented via a linear predictor. In this case, for a correlated input signal, a prediction is made for one or multiple future samples of the signal as a function of previous observed samples of the signal. This prediction is subsequently subtracted from the actual input signal. The result of this subtraction is referred to as a prediction error signal (residual signal). Thus, for example, a sinusoidal signal is completely deterministic and is therefore perfectly predictable. In this case, the residual signal would be zero for a corresponding prediction order.

In the case of a linear prediction, the prediction error signal may be written as $$r(k) = s(k) - \sum_{i=1}^{P} s(k-i)a(i),$$

where s(k) represents the sample of the input signal for the prediction at the point in time k, a(i) describes the filter coefficients of the decorrelation, and P describes the order of the prediction. The prediction error signal thus generated is generally complex-valued.

Interference noises caused by a feedback also have significantly correlated signal components. If a decorrelation is now applied to such a signal, the signal strength of the resulting prediction error signal is very low. For further use in an adaptive filter, this would mean that the adaptive filter is not excited at the frequency of the interference noise generated by the feedback. Thus, the filter is not able to adapt to the acoustic feedback path at this frequency; therefore, the interference noise remains until the acoustic feedback path changes.

Various methods exist for estimating the filter coefficients for the decorrelation by means of linear prediction, for example, the NLMS algorithm and the Levinson-Durbin recursion. In the case of the latter, the following matrix-value equation is solved recursively:

$$a=R^{-1}r,$$

where the vector a contains the coefficients a(i), and the matrix R and the vector r denote the autocorrelation matrix and the autocorrelation vector. Both values are formed via the autocorrelations $$r(j)=E\{s(k)s(k-j)\},$$

where the expected value E is a function only of the time shift j for stationary signals. In this case, the expected value may, for example, be approximated via recursive averaging.

For non-stationary signals, for example, language, the autocorrelation values are time-dependent, and should therefore preferably be repeated. However, within a time window of certain duration, most non-stationary signals may be considered to be nearly stationary. In this case, the length of this time window is a function of the degree to which the signal is non-stationary. The adaptation speed of a filter or estimator which calculates the autocorrelation values of an input signal plays an important role here: The faster the estimator, the better non-stationary signals are able to be followed, whereby a decorrelation of an input signal is improved. Thus, in order to be able to treat a non-stationary signal as stationary for a decorrelation within a short time window, an estimator is required which is as fast as possible. This also applies to any decorrelations which use a different method. Thus, for example, in the NLMS algorithm, the adaptation speed and thus the capability of decorrelating non-stationary signals is controlled via the increment.

The problem that a correlated target signal for the adaptive filter should preferably be decorrelated previously for canceling an interference noise due to feedback, but due to a decorrelation, the adaptive filter is no longer excited at the frequencies of the interference noise generated by the feedback, could now be avoided by such an interference noise being detected in a first step, and as a function of such a detection, the decorrelation being omitted in this case in a second step. However, this has several practical disadvantages: On the one hand, such a detection is always error-prone in practice. In particular if multiple frequencies which are close together are excited via the acoustic feedback, they may possibly not be sufficiently suppressed due to an insufficient spectral resolution during the detection. Furthermore, such an approach initially always requires an at least rudimentary development of an interference noise caused by the feedback, in order to bypass the corresponding signal processing block of the decorrelation when the interference noise is detected. This means that an internal signal in the acoustic system is never totally free from feedback, but contains signal components of the interference noise up to the threshold value of the detection. However, this is undesirable for reasons of sound quality.

Another option could be to determine the filter coefficients for the decorrelation in another acoustic system, and to transfer these filter coefficients continuously between the involved acoustic systems for adaptation. This option would be provided in particular in a binaural hearing device system. The aforementioned idea would be based on the assumption that the respective sound signals picked up from the surroundings by the involved acoustic systems have a high similarity, but interference noises generated due to feedback in a single system affect only the single acoustic system. Since an interference noise at a certain frequency caused by feedback will, with high probability, occur only in one acoustic system, the filter coefficients for the decorrelation which are ascertained in another acoustic system could be used as a good estimated value for the decorrelation of a target signal in the acoustic system affected by feedback. However, the presence of another acoustic system is initially required for this purpose, which is often not the case. Furthermore, a time delay of the filter coefficients may also occur as a result of the transmission, so that they are no longer current when received in the other acoustic system, or the respective filter coefficients do not constitute a sufficiently good estimate of the other system due to the spatial arrangement of the involved acoustic systems. This may occur, for example, in a binaural hearing device system due to shadowing effects caused by the head of the user.

On the other hand, the present invention now provides for initially subjecting an output signal of the acoustic system which is to be fed into a signal feedback path to a frequency distortion, and subsequently decorrelating it. In particular, a time-dependent frequency distortion may be used in this case. In the normal case, interference noises caused by feedback have a nearly perfectly sinusoidal signal. This shape is lost due to the frequency distortion. For example, if a time-dependent frequency shift is chosen for the frequency distortion, the signals of the interference noises follow this frequency shift.

The autocorrelation values of frequency-distorted signals decrease with an increasing time interval, so that the time window during which the interference signal caused by feedback may be considered to be stationary is shortened. Thus, it is possible to implement a decorrelator in such a way that it does not adapt to the interference signal of the feedback. The time window in which signals may be considered to be stationary is thus preferably to be chosen in such a way that due to the frequency distortion, the interference signal of the feedback is not considered to be stationary; however, the signal components of a target signal which are actually non-stationary, are. Thus, the decorrelation is not adapted to the interference signal, but rather only to the signal components of the target signal which get decorrelated. In the decorrelated signal, the non-stationary correlated signal components occurring during the pickup of spoken language are removed at this point, but not the signal components caused by the feedback. The decorrelated signal is now fed to the adaptive filter as an intermediate signal, which may generate a compensation signal based on the interference signal caused by feedback, which is fed back into the primary signal path for suppressing the interference noises.

Advantageously, the input signal is time-discretized, wherein a least mean square (LMS) algorithm is used as an adaptive filter. In this case, the output signal is preferably used as the reference signal, and the error signal of the LMS filter is formed by the difference between the input signal and the compensation signal. The specified method is in particular advantageous when using an LMS algorithm in the adaptive filter, since the divergence problems which occur when using an LMS algorithm for the adaptive filtering of interference signals caused by feedback are solved via the frequency distortion of the output signal.

It is also advantageous in this case if the increment in the LMS algorithm is normalized over the second intermediate signal. This approach is also referred to as the normalized least mean square (NLMS). Through such a normalization, the convergence properties of the algorithm are improved. The optimal filter coefficients are generally provided by the solution of the filter equation by means of a Wiener filter. However, it is usually not possible to use this filter due to the static properties and the limited conversion time, which is why estimates are used for the filter coefficients provided via the Wiener filter, wherein in the ideal case, the estimates converge toward the Wiener solution. In the case of an LMS algorithm for estimating the optimal filter coefficients in terms of a Wiener filter, an excessively large increment p in the proximity of the optimal solution may degrade the convergence, since a relatively large movement about the optimal solution takes place in the solution space via the iteration steps. Due to the normalization of the increment and thus due to the transition to the NLMS, the movement is refined in the proximity of the optimal filter coefficients, whereby an excessive removal from the optimal solution in the solution space is prevented in the individual iteration steps.

Advantageously, the frequency distortion for forming the output signal from the first intermediate signal is achieved via a frequency shift. In particular, a time-dependent frequency shift is used. This provides the possibility of adjusting the adaptation speed of the decorrelator to the frequency shift, thus effectively excluding the frequency-shifted signal components of the interference noise caused by the acoustic feedback from the decorrelation. However, a frequency distortion may also occur via a phase modification, a frequency transposition, or a nonlinear transformation. In this case as well, the adaptation speed of the decorrelator is preferably to be adapted to the respective degree of frequency distortion.

It is also advantageous if the output signal for forming the second intermediate signal is decorrelated by means of a linear prediction filter. The filter coefficients of the linear prediction filter are preferably to be determined by means of a Levinson-Durbin recursion or by means of an LMS or NLMS algorithm. The advantage of a linear prediction filter is that only linear equation systems must be solved for this purpose, which limits the numerical complexity for the respective filter problem. In particular, the input signal or the compensated input signal may be decorrelated via a linear prediction filter and used for forming the third intermediate signal, which is supplied to the adaptive filter an input value.

Preferably, in this case, time-dependent autocorrelation values of the output signal and/or an error signal based on the input signal are used for the filter coefficients of the linear prediction filter. In particular, the autocorrelation values may be used for a Levinson-Durbin algorithm. The consideration of the time dependence of the autocorrelation values enables an adjustment of the decorrelation to the degree of frequency distortion via the suitable choice of a corresponding time window, according to which the autocorrelation values are ascertained again in each case.

Particularly preferably, the filter coefficients of the linear prediction filter, in particular each linear prediction filter, are adapted as a function of the decorrelation strength of the frequency distortion. This means in particular that the time window in which signals may be considered to be stationary is a function of the decorrelation strength of the frequency distortion. In the case of a Levinson-Durbin algorithm, this may occur, for example, via a repeated adaptation of the autocorrelation values in the aforementioned time intervals, from which the filter coefficients must be ascertained again. In the case of an NLMS algorithm, the increment in the aforementioned time intervals may instead be correspondingly adapted.

Due to the described functional dependence of the time intervals or the stationary time window, it is possible to influence which signal components are still detected by the decorrelator as being stationary, so that the signal components of the interference signal affected by the frequency distortion are not also decorrelated. A decorrelator which has a "stationary time window" which is too short could also interpret signal components of a frequency-distorted, originally single-frequency, signal as being stationary, and therefore decorrelate them as well. This is circumvented by the adaptation speed of the decorrelation being adapted to the degree of the frequency distortion, in particular its own decorrelation strength. If, for example, a time-dependent frequency shift is chosen, it is preferably to be carried out more rapidly than signals which are considered stationary in the time window for the decorrelation.

In another advantageous embodiment of the present invention, the filter coefficients of the linear prediction filter, in particular each linear prediction filter, are adapted as a function of a transfer function of a model of the acoustic system, which comprises the at least one microphone and at least one loudspeaker reproducing the corrected output signal. In this case, the time intervals for the adaptation of the filter coefficients may in addition also be a function of the decorrelation strength of the frequency distortion. Here, the transfer function may contain the specific characteristic values of the acoustic system, for example, amplification values in individual sub-bands. The probability may also be included in such a model, at least implicitly via coefficients of the transfer function, that a feedback causes interference noises at a certain frequency. If an excitement via feedback is highly probable or above a previously established limit value for the probability, the adaptation speed of the decorrelation may be decreased in order to ensure that the frequency-distorted components of the originally single-frequency interference signal are not considered to be stationary and are also decorrelated. If a feedback is improbable, the time window for the adaptation of the decorrelator is shortened, so that tonal signal components which, for example, are generated via voice pick-up, are quickly identified and are decorrelated.

The present invention furthermore provides an acoustic system comprising at least one microphone for generating an input signal, at least one loudspeaker for reproducing an output signal, and a control unit which is configured to suppress an interference noise which is caused by feedback of the output signal, which is reproduced via the at least one loudspeaker, into the input signal generated by the at least one microphone, via the aforementioned method. In particular, the acoustic system is designed as a hearing device, and advantageously as a hearing aid device. The advantages specified for the method and its refinements may analogously be transferred to the acoustic system.

Other features which are considered as characteristic for the invention are set forth in the appended claims.

Although the invention is illustrated and described herein as embodied in a method for suppressing an interference noise in an acoustic system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
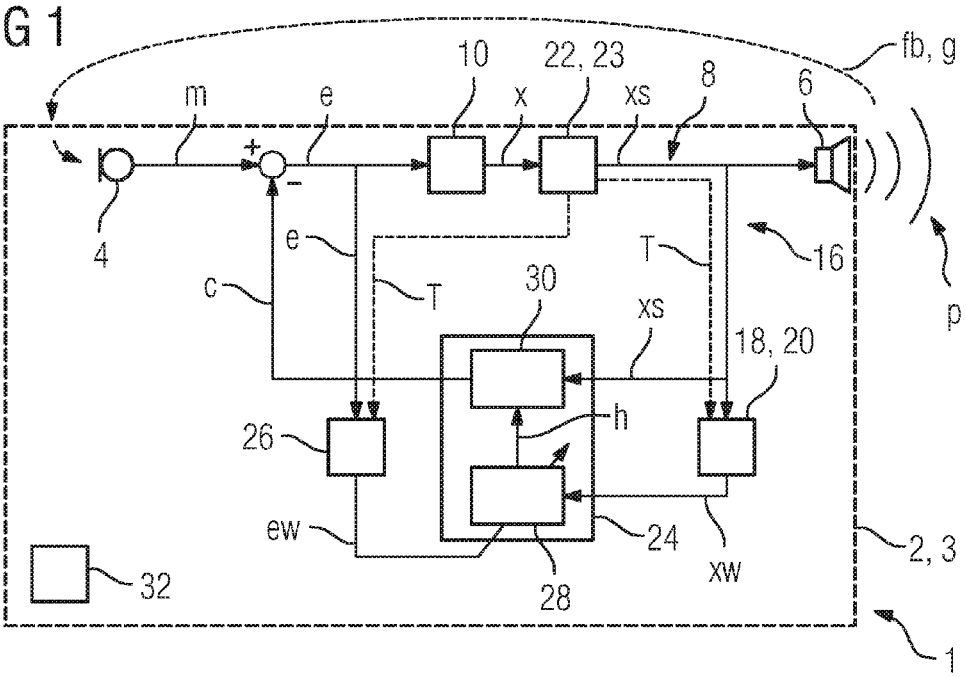
FIG. 1 shows a block diagram of the sequence of a method for suppressing an interference noise in an acoustic system.

Referring now to the figures of the drawing in detail and first, particularly, to FIG. 1 thereof, there is shown a schematic block diagram of the sequence of a method 1 for suppressing an interference noise g in an acoustic system 2. The acoustic system 2, which is provided here by a hearing device 3, for example, a hearing aid device, comprises a microphone 4 and a loudspeaker 6. The microphone signal m picked up by the microphone 4 is fed to a signal processing unit 10 in a primary signal path 8, where it is amplified, among other things. At the end of the primary signal path 8, an output signal xs is output to the loudspeaker 6, which generates an acoustic signal p from the output signal xs. A portion of the acoustic signal p generated by the loudspeaker 6 is again picked up by the microphone 4 as feedback fb, and is thus introduced into the microphone signal m. Signal components of the acoustic signal p in the microphone signal m are again fed to the signal processing unit 10 via the feedback fb and further amplified there. Via the repeated amplification, reproduction, and pickup in a closed process, interference noises g in the form of nearly single-frequency whistling tones result. To suppress the interference noises g, the signal feedback path 16 is provided.

For the signal feedback path 16, the output signal xs is decoupled from the primary signal path 8 and fed to a decorrelator 18. In this case, the decorrelator 18 is formed by a linear prediction filter 20.

In the primary signal path 8, the signal processing unit 10 outputs a first intermediate signal x which is converted via a frequency distortion 22 into the output signal xs. The frequency distortion 22, which is achieved in the present case via a frequency shift 23, results in the linear prediction filter 20 not decorrelating the signal components corresponding to the interference noises g, but rather only signal components of a target signal. A second intermediate signal xw is output by the linear prediction filter 20 as an input value to an adaptive filter 24. The adaptive filter 24 generates a compensation signal c from the output signal xs, which is subtracted from the microphone signal m for compensating for the interference noises g. The signal feedback path 16 is thereby closed.

For generating the compensation signal c, an additional intermediate signal ew is fed to the adaptive filter 24 as an input signal. This third intermediate signal ew is formed from the error signal e which results from the microphone signal m compensated by the compensation signal c. The error signal e is now likewise decorrelated via a linear prediction filter 26, and the decorrelated error signal ew is fed to the adaptive filter 24 as a second input value. The coefficients h are now calculated from the decorrelated error signal ew and the second intermediate signal xw in a filter block 28 of the adaptive filter 24, from which a signal block 30 of the adaptive filter generates the compensation signal c in conjunction with the output signal xs.

It is thus ensured via the frequency shift 23 that the linear prediction filter 20 does not decorrelate any signal components belonging to the interference noises g, whereby the adaptive filter 24 would no longer compensate for them with the compensation signal c. The length of the stationary time window T of the linear prediction filters 20, 26, and thus their adaptation speed, is controlled as a function of the frequency shift 23. A control unit 32 in the hearing device 3 carries out all specified method steps.

Figure 2:
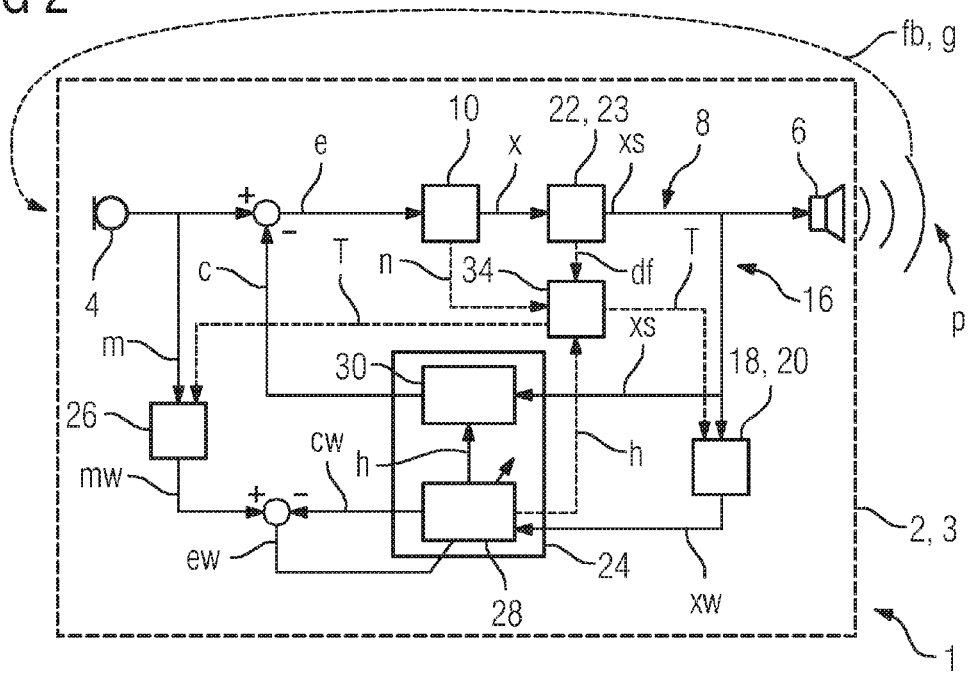
FIG. 2 shows a block diagram of an additional possible embodiment of the method according to FIG. 1.

In FIG. 2, a slight modification of the method 1 depicted in FIG. 1 is shown in a block diagram. Here, in the acoustic system 2, i.e., in particular in a hearing device 3, for example, in a hearing aid device, the decorrelated error signal ew, which is fed to the adaptive filter as an input value, is formed from an input signal mw decorrelated in the linear prediction filter 26 and a decorrelated compensation signal cw. The decorrelated compensation signal cw is formed in the filter block 28 of the adaptive filter from the error signal ew decorrelated in the linear prediction filter 26 and the second intermediate signal xw, which is provided by the output signal xs decorrelated in the linear prediction filter 20. The length of the stationary time window T of the linear prediction filters 20, 26, and thus their adaptation speed, is determined via an adaptation controller 34 into which the degree df of the frequency shift 23, the gain n of the signal processing unit 10 in individual sub-bands, and a transfer function of the acoustic system 2 which is not depicted in greater detail, are introduced and are used for determining the time window T. Likewise, in this case, a model of the acoustic feedback path fb determined via the filter coefficients h may also be used, so that the adaptation speed of the decorrelation in the linear prediction filters 20, 26 is also determined as a function of the feedback estimated via this model. The use of such an adaptation controller 34 is not limited to the form of the signal feedback path 16 depicted in FIG. 2, but may be used in principle in various embodiment variants, in particular in the exemplary embodiment shown in FIG. 1.

Although the present invention was illustrated and described in detail via the preferred exemplary embodiment, the present invention is not limited by this exemplary embodiment. Other variations may be derived from it by those skilled in the art without departing from the scope of protection of the present invention.

The invention claimed is:

1. A method for suppressing an interference noise in an acoustic system, wherein the acoustic system including at least one microphone and at least one loudspeaker, the at least one microphone generating an input signal and the at least one loudspeaker generating an acoustic signal which partially feeds back to the at least one microphone, the method comprising: forming a first intermediate signal along a primary signal path as a function of the input signal and forming an output signal from the first intermediate signal via a frequency distortion; coupling the output signal out from the primary signal path into a signal feedback path; forming a second intermediate signal in the signal feedback path from the output signal via a decorrelation, inputting the second intermediate signal as an input value for an adaptive filter, generating a compensation signal by the adaptive filter, and feeding the compensation signal to the input signal to form a compensated input signal; forming a third intermediate signal from the input signal and/or from the compensated input signal, and using the third intermediate signal as an input value for the adaptive filter; and feeding the output signal to the at least one loudspeaker for reproduction; wherein the frequency distortion for forming the output signal from the first intermediate signal is a temporally-dependent frequency shift.

2. The method according to claim 1, which comprises time-discretizing the input signal and using a least mean square algorithm as the adaptive filter.

3. The method according to claim 2, which comprises normalizing an increment in the LMS algorithm over the second intermediate signal.

4. The method according to claim 1, wherein the frequency distortion for forming the output signal from the first intermediate signal is a frequency shift.

5. The method according to claim 1, which comprises decorrelating the output signal for forming the second intermediate signal by way of a linear prediction filter.

6. The method according to claim 5, which comprises using time-dependent autocorrelation values of the output signal and/or an error signal based on the input signal for filter coefficients of the linear prediction filter.

7. The method according to claim 6, which comprises adapting the filter coefficients of the linear prediction filter as a function of a decorrelation strength of the frequency distortion.

8. The method according to claim 7, which comprises adapting the filter coefficients of the linear prediction filter as a function of a transfer function of a model of the acoustic system, which includes the at least one microphone and the at least one loudspeaker reproducing the corrected output signal.

9. The method according to claim 5, which comprises adapting filter coefficients of the linear prediction filter as a function of a decorrelation strength of the frequency distortion.

10. The method according to claim 5, which comprises adapting filter coefficients of the linear prediction filter as a function of a transfer function of a model of the acoustic system, which includes the at least one microphone and the at least one loudspeaker reproducing the corrected output signal.

11. An acoustic system, comprising:

at least one microphone for generating an input signal;

at least one loudspeaker for reproducing an output signal; and a control unit configured to carry out the method according to claim 1 for suppressing an interference noise due to a feedback of the output signal, which is reproduced via the at least one loudspeaker, into the input signal generated by the at least one microphone.

12. The acoustic system according to claim 11, configured as a hearing device.

13. The acoustic system according to claim 11, configured as a hearing aid device.

14. A method for suppressing an interference noise in an acoustic system, wherein the acoustic system including at least one microphone and at least one loudspeaker, the at least one microphone generating an input signal and the at least one loudspeaker generating an acoustic signal which partially feeds back to the at least one microphone, the method comprising:

forming a first intermediate signal along a primary signal path as a function of the input signal and forming an output signal from the first intermediate signal via a frequency distortion;

coupling the output signal out from the primary signal path into a signal feedback path;

forming a second intermediate signal in the signal feedback path from the output signal via a decorrelation, inputting the second intermediate signal as an input value for an adaptive filter, generating a compensation signal by the adaptive filter, and feeding the compensation signal to the input signal to form a compensated input signal;

forming a third intermediate signal from the input signal and/or from the compensated input signal, and using the third intermediate signal as an input value for the adaptive filter; and feeding the output signal to the at least one loudspeaker for reproduction;

wherein the frequency distortion for forming the output signal from the first intermediate signal is a temporally-dependent frequency shift.

15. The method according to claim 14, which comprises time-discretizing the input signal and using a least mean square algorithm as the adaptive filter.

16. The method according to claim 15, which comprises normalizing an increment in the LMS algorithm over the second intermediate signal.

17. The method according to claim 16, which comprises decorrelating the output signal for forming the second intermediate signal by way of a linear prediction filter.

18. The method according to claim 17, which comprises using time-dependent autocorrelation values of the output signal and/or an error signal based on the input signal for filter coefficients of the linear prediction filter.

19. The method according to claim 18, which comprises adapting the filter coefficients of the linear prediction filter as a function of a decorrelation strength of the frequency distortion.

20. The method according to claim 19, which comprises adapting the filter coefficients of the linear prediction filter as a function of a transfer function of a model of the acoustic system, which includes the at least one microphone and the at least one loudspeaker reproducing the corrected output signal.

21. The method according to claim 17, which comprises adapting filter coefficients of the linear prediction filter as a function of a decorrelation strength of the frequency distortion.

22. The method according to claim 17, which comprises adapting filter coefficients of the linear prediction filter as a function of a transfer function of a model of the acoustic system, which includes the at least one microphone and the at least one loudspeaker reproducing the corrected output signal.

23. A method for suppressing an interference noise in an acoustic system, wherein the acoustic system including at least one microphone and at least one loudspeaker, the at least one microphone generating an input signal and the at least one loudspeaker generating an acoustic signal which partially feeds back to the at least one microphone, the method comprising: forming a first intermediate signal along a primary signal path as a function of the input signal and forming an output signal from the first intermediate signal via a frequency distortion; coupling the output signal out from the primary signal path into a signal feedback path; forming a second intermediate signal in the signal feedback path from the output signal via a decorrelation, inputting the second intermediate signal as an input value for an adaptive filter, generating a compensation signal by the adaptive filter, and feeding the compensation signal to the input signal to form a compensated input signal; forming a third intermediate signal from the input signal and/or from the compensated input signal, and using the third intermediate signal as an input value for the adaptive filter; and feeding the output signal to the at least one loudspeaker for reproduction; and decorrelating the output signal for forming the second intermediate signal by way of a linear prediction filter; and adapting the filter coefficients of the linear prediction filter as a function of a decorrelation strength of the frequency distortion; wherein the frequency distortion for forming the output signal from the first intermediate signal is a temporally-dependent frequency shift.

24. The method according to claim 23, which comprises time-discretizing the input signal and using a least mean square algorithm as the adaptive filter.

25. The method according to claim 24, which comprises normalizing an increment in the LMS algorithm over the second intermediate signal.

26. The method according to claim 23, wherein the frequency distortion for forming the output signal from the first intermediate signal is a frequency shift.

27. The method according to claim 23, which comprises using time-dependent autocorrelation values of the output signal and/or an error signal based on the input signal for filter coefficients of the linear prediction filter.

28. The method according to claim 23, which comprises adapting the filter coefficients of the linear prediction filter as a function of a transfer function of a model of the acoustic system, which includes the at least one microphone and the at least one loudspeaker reproducing the corrected output signal.

29. The method according to claim 23, which comprises adapting filter coefficients of the linear prediction filter as a function of a decorrelation strength of the frequency distortion.

30. The method according to claim 23, which comprises adapting filter coefficients of the linear prediction filter as a function of a transfer function of a model of the acoustic system, which includes the at least one microphone and the at least one loudspeaker reproducing the corrected output signal.

* * * * *